US009371176B2

(12) United States Patent
Kohli et al.

(10) Patent No.: US 9,371,176 B2
(45) Date of Patent: Jun. 21, 2016

(54) CAPSULE FOR PREPARING A BEVERAGE OR NUTRITIONAL PRODUCT

(71) Applicant: Nestec S.A., Vevey (CH)

(72) Inventors: Hans Markus Kohli, Montagny-prés-Yverdon (CH); Sophie Abraham, Remoray (FR); Nihan Dogan, La Croix-sur-Lutry (CH); Heinz Wyss, Oberdiessbach (CH); Wolfgang Zangerle, Mellingen (CH)

(73) Assignee: Nestec S. A., Vevey (CH)

( * ) Notice: Subject to any disclaimer, the term of this patent is extended or adjusted under 35 U.S.C. 154(b) by 0 days.

(21) Appl. No.: 14/646,974

(22) PCT Filed: Nov. 22, 2013

(86) PCT No.: PCT/EP2013/074446
§ 371 (c)(1),
(2) Date: May 22, 2015

(87) PCT Pub. No.: WO2014/082924
PCT Pub. Date: Jun. 5, 2014

(65) Prior Publication Data

US 2015/0284179 A1 Oct. 8, 2015

(30) Foreign Application Priority Data

Nov. 29, 2012 (EP) ..... 12194775

(51) Int. Cl.
*B65D 85/804* (2006.01)

(52) U.S. Cl.
CPC ..... *B65D 85/8043* (2013.01); *Y10T 29/49826* (2015.01)

(58) Field of Classification Search
CPC ..... B65D 85/8043
See application file for complete search history.

(56) References Cited

FOREIGN PATENT DOCUMENTS

| | | | |
|---|---|---|---|
| EP | 1440905 | A1 | 7/2004 |
| WO | 2010112353 | A1 | 10/2010 |
| WO | 2010128028 | A1 | 11/2010 |
| WO | 2010128031 | A1 | 11/2010 |
| WO | 2010128051 | A1 | 11/2010 |

OTHER PUBLICATIONS

International Search Report, mailed Feb. 26, 2014, in PCT/EP2013/074446, filed Nov. 22, 2013.
Written Opinion of the International Search Report, mailed Feb. 26, 2014, in PCT/EP2013/074446, filed Nov. 22, 2013.

*Primary Examiner* — Erik Kashnikow
*Assistant Examiner* — Chaim Smith
(74) *Attorney, Agent, or Firm* — Dunlap Codding, P.C.

(57) ABSTRACT

A capsule for preparing a beverage and/or nutritional product is disclosed that includes a body that forms a first compartment for liquid injection and a second compartment for containing beverage and/or nutritional ingredients. A separation wall separates the first and second compartments and includes an aperture for the liquid transfer from the first compartment to the second compartment. A separate liquid injector is inserted in and/or against the separation wall and is arranged for transferring liquid from the first compartment to the second compartment.

16 Claims, 8 Drawing Sheets

CAPSULE FOR PREPARING A BEVERAGE OR NUTRITIONAL PRODUCT

CROSS REFERENCE TO RELATED APPLICATIONS/INCORPORATION BY REFERENCE STATEMENT

This application is a U.S. national stage application filed under 35 USC §371 of International Application No. PCT/EP2013/074446, filed Nov. 22, 2013; which claims benefit of EP Application No. 12194775.8, filed Nov. 29, 2012. The entire contents of the above-referenced applications are hereby expressly incorporated herein by reference.

FIELD OF THE INVENTIVE CONCEPT(S)

The presently disclosed and/or claimed inventive concept(s) is directed to a capsule for preparing a beverage and/or nutritional product in a beverage preparation device. In the capsule of the presently disclosed and/or claimed inventive concept(s) a section, into which liquid can be injected by a beverage preparation machine, is separated from a section for containing beverage and/or nutritional ingredients. The separation is bridged by internal injection means for injecting the liquid to the ingredients.

BACKGROUND

From the prior art it is known to prevent a direct contact between the liquid injection means of a beverage preparation machine, for example designed as a needle or a connector, and the beverage or nutritional ingredients contained in a capsule.

For example, WO 2010/112353 A1 discloses a capsule for use in a beverage production device. The capsule comprises a filter for filtering a liquid injected into the capsule, a collection member placed downstream of the filter to collect the filtered liquid, and at least one restriction orifice in the collection member, in order to focus the flow of the liquid in at least one jet of liquid at high velocity into a compartment of the capsule, in which beverage ingredients are contained.

WO 2010/128028 A1 discloses a capsule for the preparation of a nutritional product for use in a device that is adapted to supply a liquid to the capsule. The capsule comprises a filter for removing contaminants contained in the injected liquid. After passing through the filter, the liquid is supplied to at least one compartment containing beverage ingredients. The capsule further comprises a selectively openable gas inlet, which is placed on or in the capsule to allow gas introduction from the outside into the ingredients compartment without passing through the filter.

WO 2010/128031 A1 discloses a capsule for the preparation of a nutritional product for use in a device that is adapted to inject a liquid to the capsule. The capsule comprises a compartment, which houses a filter for removing contaminants contained in the injected liquid. The capsule further comprises a compartment for beverage ingredients. The filter has a filtering surface, which is smaller than the cross-section of the mouth of the ingredient compartment.

WO 2010/128051 A1 discloses a capsule for the preparation of a nutritional product in a device that is adapted to supply a liquid into the capsule. The capsule comprises a filter unit, which comprises a filter membrane and an outlet wall for supporting the filter membrane. The outlet wall of the filter unit comprises at least one liquid outlet that communicates with a compartment of the capsule, in which beverage ingredients are contained.

None of the known prior art mentioned above takes into account that depending on the type of beverage and/or nutritional ingredients contained in a capsule, the injection of the liquid needs to be carried out differently, in order to properly dissolve different types of ingredients. For example, for some beverage ingredients in a capsule, a directed jet of liquid is optimal for dissolving, whereas for other beverage ingredients in a capsule, a spraying of the liquid onto the ingredients is optimal for dissolving.

Thus, there is a need for injection means that are designed to achieve a proper dissolution of ingredients in a capsule. In particular, there is a need for a capsule that provides a sufficiently flexible and versatile solution for different beverage and/or nutritional products.

Further, there is a need for a filtering function in the capsule for removing contaminants from the liquid, which is safe, simple and economical to implement industrially.

The prior art capsules have the further disadvantage that they encompass too many pieces, and are thus costly to produce. The prior art capsules also require time consuming and complex assembling operations to ensure the proper fluid flow path through the capsule. Consequently, there is a need to reduce the number of pieces, facilitate the assembling and reduce the manufacturing costs of a capsule.

BRIEF DESCRIPTION OF THE DRAWINGS

In the following the presently disclosed and/or claimed inventive concept(s) will be described in more detail with reference to the attached drawings.

DETAILED DESCRIPTION

Figure 1:
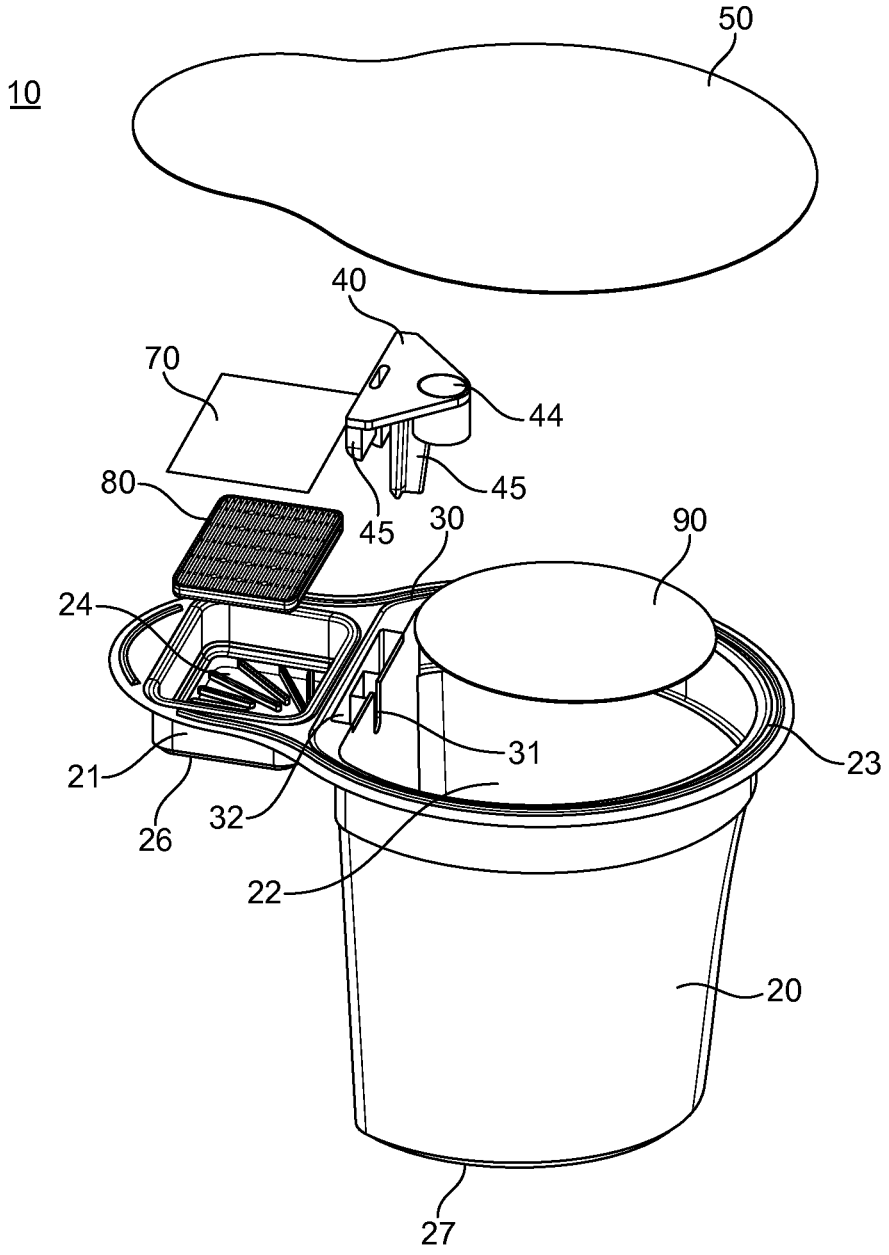
FIG. 1 shows a perspective view of a disassembled capsule of the presently disclosed and/or claimed inventive concept(s).

The presently disclosed and/or claimed inventive concept(s) has a non-limiting object to improve the prior art by addressing the above-mentioned disadvantages. In particular, the presently disclosed and/or claimed inventive concept(s) aims to provide a capsule with injection means which can be easily and economically adapted for properly dissolving any type of ingredients in the capsule. The presently disclosed and/or claimed inventive concept(s) has the further non-limiting object to provide a simpler designed capsule, which enables a larger versatility in the choice of an injection solution, and for added functionalities like filtering, proper ingredient dissolution and/or foaming. Finally, another non-limiting object of the presently disclosed and/or claimed inventive concept(s) is to provide a capsule, which can be assembled faster and in a simpler manner, and can be manufactured at lower costs than the prior art solutions.

In general the solution to the above-mentioned objects is provided by a capsule for the preparation of a beverage and/or nutritional product comprising a separate insertable liquid injector. The capsule is particularly designed as described by the attached independent claims. The attached dependent claims develop further advantages of the presently disclosed and/or claimed inventive concept(s).

The presently disclosed and/or claimed inventive concept(s) is directed to a capsule for preparing a beverage and/or nutritional product, comprising a body for forming integrally a first compartment for liquid injection and a second compartment for containing beverage and/or nutritional ingredients, a separation wall for separating the first compartment and the second compartment, the separation wall comprising an aperture for liquid transfer from the first compartment to the second compartment, a liquid injector comprising a liquid inlet and a liquid outlet, wherein the liquid injector is inserted in and/or against the separation wall, and is arranged for transferring liquid from the first compartment to the second compartment.

A sustainable hygienic product delivery is obtained by the separation between the first compartment (into which the liquid is injected by injecting means of a beverage preparation machine) and the second compartment, which is for holding the beverage and/or nutritional ingredients. The ingredients in the capsule cannot be contaminated by the injecting means.

Further, during assembling of the capsule of the presently disclosed and/or claimed inventive concept(s), differently designed liquid injectors can be inserted depending on the ingredients to be filled into the capsule. The liquid injector may be designed, in particular, non-limiting embodiments, such that these ingredients to be filled into the capsule can be dissolved properly and no non-dissolved lump of product is left in the capsule or released from the capsule. For example, the liquid injector can be designed to form at its liquid outlet one or more jets of liquid or a spray of liquid for further injection into the second compartment. The liquid outlet can therefore be designed as one or more holes, orifices or channels having a diameter that is tailored to the specific needs. Thus, the capsule of the presently disclosed and/or claimed inventive concept(s) offers an increased versatility of use. The liquid injector can be selectively adapted or selected at the manufacturing of the capsule while the rest of the capsule remains unchanged or with limited changes so that the capsule can be used for different intended beverage and/or nutritional ingredients. Furthermore, the capsule encompasses fewer pieces. Therefore, the capsules can be manufactured at lower costs.

Moreover, the insertion of the liquid injector into and/or against the separation wall allows for a fast and simple assembly of the capsule. Further, additional functionalities like a filtering before the injection of liquid into the ingredient compartment or foaming can be added due to the design of the capsule, as will be explained below in more detail.

In one particular, non-limiting embodiment, the liquid injector comprises an air injection channel with an air inlet separate from the liquid inlet.

The air can be injected by a beverage preparation machine, which also provides the injected liquid. The injected air helps to completely drain the capsule from the injected liquid after the liquid injection in the capsule. The air injection time generally depends on the volume of the capsule to be drained (i.e., the larger the volume, the longer the time). Injected air can also be injected during liquid injection into the second compartment such as to improve the dissolution of the ingredients contained therein and/or voluntarily create air bubbles in the liquid. Injected air can for example increase the speed of one or more liquid jets directed through one or more openings of the liquid outlet of the liquid injector. Injected air can also enhance a spraying effect of the liquid, which leaves the liquid injector through a plurality of openings forming the liquid outlet. Injected air can also support the formation of foam of a beverage or nutritional liquid product that is produced.

The air inlet is positioned sufficiently remote from the ingredient compartment so that no contact is made possible between the air injection means of the device and the product or ingredient, even after liquid injection. For this, an air channel may be present between the air inlet and the air outlet communicating with the second compartment of the capsule. In one particular, non-limiting embodiment, the air channel is of a length greater than 5 mm.

In a mode, the liquid outlet of the liquid injector and air outlet are common. This provides the advantage that all liquid is removed from the injector. Also air under pressure can assist for dislodging solid particles from the liquid outlet(s) which may otherwise clog the outlet(s). The injector remains of simpler conception and can be built more compact. Additionally, a liquid air mixture can be provided to the beverage and/or nutritional ingredients in the capsule, which may promote the dissolution of the beverage ingredients.

In an alternative, the air outlet and liquid outlet are separately formed in the liquid injector. In such case, the air flow path and liquid flow path are separate. In another alternative, the liquid injector can be built without air inlet. It can be possible for example when the capsule can drain by itself without assistance of pressurized air.

In a particular, non-limiting embodiment, the liquid injector has insertion means for fitting the liquid injector into complementary receiving means of the separation wall. In a most particular, non-limiting embodiment, the insertion means and receiving means are arranged to permit an insertion of the liquid injector in or along the direction of extension of the separation wall so that the liquid injector becomes immobilized in, at least the transversal direction to the direction of extension of the separation wall.

The capsule is so simple to assemble, since the liquid injector is stably fixed in engagement with the separation wall into the receiving means without need for additional connection means. In particular, no permanent connecting means, generally requiring specific manufacturing operations, such as welding, gluing or riveting, is needed. Differently designed liquid injectors with equal insertion means can be used. The number of necessary pieces to hold the liquid injector stably inside the capsule in and/or against the separation wall is so minimized.

In a more specific mode, the insertion means are shaped as teeth and/or studs. In a particular, non-limiting embodiment, the teeth or studs extends essentially in the direction of, and/or parallel to, the separation wall. This allows the insertion of the liquid injector in the direction of the separation wall.

In a particular, non-limiting embodiment, the receiving means are complementary shaped to receive the teeth and/or studs. In particular, the receiving means are recesses and/or slots. Therefore, the recesses and/or slots extend essentially in the direction of, and/or parallel to, the separation wall.

In a particular, non-limiting embodiment, the first compartment and the second compartment are arranged adjacent to each other in a direction that is orthogonal to the liquid and/or air inlet of the liquid injector. Therefore, the separation wall forms at least a partial separation orthogonal to the liquid and/or air inlet of the liquid injector. In a particular, non-limiting embodiment, the separation of the two compartments is completed by the liquid injector in position of insertion in and/or against the separation wall.

The first compartment and the second compartment are adjacent to each other and separated, at least partially, by the separation wall when viewed from above. This promotes an uncomplicated arrangement of liquid injecting means and air injecting means of a beverage producing device. The capsule can also be assembled easily in an automated manufacturing process.

In particular, the capsule further comprises an upper membrane for closing the (so adjacent) first and second compartments, the upper membrane being sealed on the separation wall and on edges of the compartments. The sealed upper membrane may further prevent the liquid injection from being freely removed in the opposed direction of the insertion. In other words, the membrane maintains the liquid injector in inserted position without possibility for the liquid injector to be removed.

Using only one membrane to seal both compartments reduces the number of pieces and lowers the assembling costs.

In a particular, non-limiting embodiment, the first compartment and the second compartment are side-by-side when viewed perpendicular to the upper membrane.

In a particular, non-limiting mode, the first compartment comprises a filter for filtering liquid introduced in the first compartment. In a particular, non-limiting embodiment, the filter is a means separate from the liquid injector. In a particular, non-limiting embodiment, the filter is designed for removing contaminants from the fed liquid. In a particular, non-limiting embodiment, the filter is welded into the first compartment in a manner to prevent any bypass of unfiltered liquid to the liquid injector.

In a possible alternative, the first compartment is free of filter. The first compartment can simply form a chamber of relatively small size for simply lodging the liquid injection means, e.g., injection needle, of the beverage preparation device.

In another alternative, the first compartment contains a beverage or food ingredient distinct from the food ingredient contained in the second compartment. For example, the first compartment can comprise: probiotic(s), oligo-elements, vitamins, other food or nutritional additives, a taste enhancer, a sweetener, a flavor, a colorant, a creamer and combinations thereof.

In a particular, non-limiting embodiment, the filter is intended to remove liquid contaminants from the supplied liquid, before it is injected further into the second compartment containing the beverage and/or nutritional ingredients. Thereby, the hygiene of beverage production is improved.

The "contaminant" refers to microorganisms such as: bacteria, viruses, but may also encompass under certain circumstances: organic chemicals such as: acrylamide, benzene, carbofuran; inorganic chemicals such as: arsenic, cadmium, cyanide, fluoride, mercury, nitrate, nitrite; disinfectants such as: chloramines, chlorine, chlorine dioxide; disinfection byproducts such as: bromate, chlorite, haloacetic acids (HAA5), trihalomethanes (TTHMs); metals such as: zinc, silver, lead; radionuclides; organic or inorganic macro-elements such as: sand, hair or dirt; abnormal pH; and undesired odor.

For example, the filter can be any one of: a nano- or microporous membrane, a filtering porous block (e.g. a sintered ceramic or metallic material), ion-exchange resin, an active carbon filter, an adsorbing or desorbing medium, a metallic mesh screen, a filtering bed of inert particles and combinations thereof.

In a particular, non-limiting embodiment, the capsule further comprises a support means in the first compartment to support the filter. The support means can be a grid placed downstream of the filter for supporting the filter in the first compartment or be support elements, positioned downstream of the filter, and formed integrally with the compartment. The filter can be laid onto the support grid during assembling and can be welded, for example, to a step structure in the first compartment. The assembling of the filter in the capsule is thus easy and fast. Furthermore, by providing support to the filter, the support grid helps to prevent that the filter is damaged during the injection of liquid into the capsule under high pressure.

In a particular, non-limiting mode, the filter may be a thin membrane, which is prone to accidental rupture under excessive liquid pressure.

In a particular, non-limiting embodiment, for antimicrobial purposes, the filter membrane has a pore size of less than 0.4 microns, such as but not limited to, less than 0.2 microns. It may have a thickness of less than 500 microns, such as but not limited to, between 10 and 300 microns. The material of the membrane can be chosen from the list consisting of PES (polyethersulfone), cellulose acetate, cellulose nitrate, polyamide and combinations thereof.

In a particular, non-limiting embodiment, the support grid is clipped in the first compartment. Thus, the assembly of the support grid is again easy and fast. In a more particular, non-limiting embodiment, the support grid is made of hard injected plastic. The grid may have a wall thickness providing a sufficient rigidity such as between 0.5 and 2 mm.

In a particular, non-limiting embodiment, the support grid (or respectively support elements) is (respectively, are) supported on a bottom wall of the first compartment. The support grid comprises a plurality of through-holes and the support grid and/or the first compartment comprises means for maintaining a flow path between the bottom wall of the first compartment and the support grid.

A liquid flow path including the filter is thus realized in a simple manner and with only few pieces within the capsule. Means for maintaining the flow path provided to the support grid can be designed as ridges and/or braces disposed on one surface of the grid. Means for maintaining the flow path provided to the first compartment can be designed as ridges provided to the bottom wall, and in a particular, non-limiting embodiment, provided integrally with said bottom wall, of the first compartment.

The beverage and/or nutritional ingredient in the second compartment can be chosen amongst: infant formula, milk (solid or liquid) concentrate, ground coffee, soluble coffee, leaf tea, soluble tea, herbal tea, cocoa, chicory, culinary powder, soup powder, nutritional composition, and combinations thereof.

The presently disclosed and/or claimed inventive concept(s) is further directed to a method for manufacturing a capsule for preparing a beverage or nutritional product, comprising the steps of forming integrally a first compartment for liquid injection and a second compartment for containing beverage and/or nutritional ingredients of a body with a separation wall between the first compartment and the second compartment; providing a liquid injector comprising a liquid inlet and a liquid outlet, inserting the liquid injector in and/or against the separation wall so that the liquid injector is arranged for transferring liquid from the first compartment to the second compartment.

The manufacturing method of the presently disclosed and/or claimed inventive concept(s) allows for versatile, cost effective and easy assembling of capsules suitable for different kinds of beverage and/or nutritional ingredients. These capsules might differ essentially in the liquid injector that is used and inserted into the separation wall.

Figure 2:
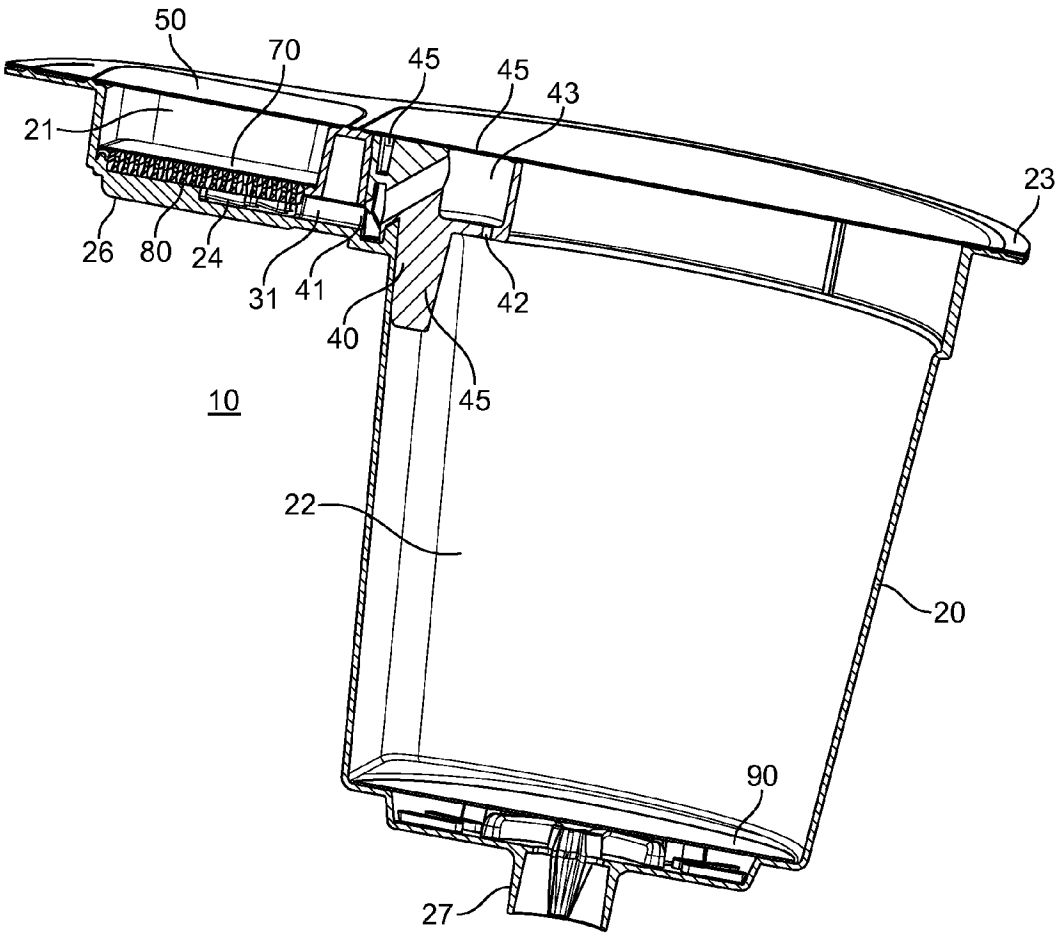
FIG. 2 shows a perspective view of an assembled capsule of the presently disclosed and/or claimed inventive concept(s).

FIG. 1 and FIG. 2 show a capsule 10 of the presently disclosed and/or claimed inventive concept(s). FIG. 1 shows the capsule 10 in a disassembled state, wherein the individual parts of the capsule are illustrated in an exploded view. FIG. 2 shows the capsule 10 having the same parts in an assembled state. The capsule 10 of the presently disclosed and/or claimed inventive concept(s) could also be called a cartridge, container, cassette or the like.

The capsule 10 comprises a body 20 for forming integrally a first compartment 21 and a second compartment 22. The body 20 is (in a particular, non-limiting embodiment) made of a plastic, but can also be made of a thin metal, or cardboard laminate (e.g., moulded cellulose pulp), or starch-based polymer. The second compartment 22 is for holding beverage and/or nutritional ingredients. The ingredients are (in a particular, non-limiting embodiment) held in powdered or semi-liquid (e.g. liquid concentrate) form. Such beverage and/or nutritional ingredients are for example coffee, tea, chocolate, milk based products, food products and the like. The first compartment 21 is for receiving a liquid, like water or another suited diluent such as milk, into the capsule 10, supplied from injection means of a beverage preparation machine. The injection means of the beverage preparation machine, such as an injection needle, does not come into direct contact with the beverage and/or nutritional ingredients in the capsule 10. Thereby, the risk of contaminating the ingredients is significantly reduced.

The second compartment 22 has (in a particular, non-limiting embodiment) a larger volume and a mouth opening larger than the first compartment 21. The first compartment 21 has a bottom wall 26 and the second compartment 22 has a bottom wall with a liquid outlet 27 on the lower side of the capsule 10. The body 20 forms both compartments 21 and 22 in such a manner that they are open on the upper side of the capsule 10. The second compartment 22 can thus be filled with the beverage and/or nutritional ingredients. Into the first compartment 21 e.g. a filter can be inserted. The filter can be designed to selectively remove certain contaminants (upon needs) of the liquid fed in the first compartment. The upper side of the capsule body 20 is delimited by an edge 23 or a rim. The edge or rim forms a continuously closed circumference which demarcates the compartments outwardly.

Between the first compartment 21 and the second compartment 22 is arranged a separation wall 30 for separating the two compartments 21, 22. The separation wall 30 can be formed integrally with the body 20 of the capsule. The separation wall 30 comprises an aperture 31 or a through-hole designed such that liquid could pass from the first compartment 21 to the second compartment 22.

An upper membrane 50 is attached during assembling of the capsule 10 to the upper edge 23 of the body 20. The upper membrane 50 is used for closing off the first compartment 21 and the second compartment 22, respectively, at the liquid inlet side of the capsule 10. The upper membrane 50 is (in a particular, non-limiting embodiment) sealed (e.g., heat or ultrasonically welded) on the separation wall 30 and on the edges 23 of the compartments 21 and 22. The upper membrane 50 is (in a particular, non-limiting embodiment) of material suitable to protect the ingredients inside the capsule 10 against moisture and external air, and prevent contamination of the inside of the capsule 10 from external contamination sources. The upper membrane 50 can, for example, be made of aluminum, other thin metal sheets or a plastic such as PP or PE, or a laminate of plastics such as PP-EVOH-PET, PP-SiOx-PET, PP-PET or plastic/metal such as PP-Aluminium.

For injecting liquid into the capsule 10, a beverage preparation machine can perforate the upper membrane 50 above the first compartment 21 with injection means like a perforating connector or a needle, and can thus supply the liquid into the first compartment 21. The injected liquid is further transferred from the first compartment 21 to the second compartment 22.

When the delivery of liquids is intended with an elevated safety or hygiene requirement, such as for an infant formula, the capsule 10 (in a particular, non-limiting embodiment) comprises a filter 70, which is provided in the first compartment 21, for filtering contaminants from liquid supplied by the beverage preparation machine. A good hygienic solution is obtained by a filter 70 which is a membrane with nano- or micro-pores such as discussed in WO 2008/012314. The filter 70 is used to prevent contamination of the beverage and/or nutritional ingredients in the capsule 10 by the supplied filtered liquid.

In a particular, non-limiting embodiment, the filter is clipped or clamped into the first compartment 21. Thereby, the filter 70 is (in a particular, non-limiting embodiment) supported at least indirectly by the bottom wall 26 of the first compartment 21. The FIGS. 1 and 2 show that the filter 70 is preferably supported on a support grid 80. As a result, the deflection of the filter is controlled and the filter can withstand high pressure liquid that is injected into the capsule. The support grid 80 is (in a particular, non-limiting embodiment) supported on the bottom wall 26 of the first compartment 21. The support grid 80 is provided (in a particular, non-limiting embodiment) with distancing means 24, or on distancing means 24, which ensure that a liquid flow path remains open between the bottom wall 26 of the first compartment 21 and the support grid 80. Through said flow path the liquid can flow into the aperture 31, and further to the second compartment 22. The means 24 can be provided either on the bottom wall 26 of the first compartment or on the support grid 80.

The filter membrane can be connected to the grid before insertion in the first compartment ("pre-assembling"). This has the advantage that the filter can more easily be manipulated during its placement in the capsule. For instance, the filter is welded to the grid in localized areas.

The separation wall 30 between the two compartments 21 and 22 has receiving means 32, which are designed, in a particular, non-limiting embodiment, as recesses and/or slots, and are provided into the upper surface of the separation wall 30. The receiving means 32 are arranged complementarily with insertion means of the liquid injector 40 so that the insertion means fit in the receiving means such as in a tight sliding fit relationship. The liquid injector 40 is thus provided with insertion means 45, which are designed (in a particular, non-limiting embodiment) as teeth and/or studs designed to fit into the receiving means 32 of the separation wall 30 in a sliding manner. The liquid injector 40 is thus selectively insertable and removable into or against the separation wall 30 during assembling of the capsule 10. In the assembled capsule 10 the liquid injector 40 is inserted in and/or against the separation wall 30.

The liquid injector 40 has a liquid inlet 41 and a liquid outlet 42. When inserted into and/or against the separation wall 30, the liquid injector 40 is arranged such that liquid can flow from the first compartment 21, into the aperture 31, and into the liquid inlet 41 of the liquid injector 40. The liquid is then guided through the liquid injector 40 and is finally injected (or expelled) into the second compartment 22 via the liquid outlet 42. The liquid outlet 42 is (in a particular, non-limiting embodiment) oriented perpendicular to the plane of the upper membrane 50, i.e. oriented (in a particular, non-limiting embodiment) parallel to the direction of the liquid injection into the capsule 10, and (in a particular, non-limiting embodiment) orthogonal to the direction, into which the first compartment 21 and the second compartment 22 are arranged side-by-side, which is may also be the extension direction of the aperture 31 through the separation wall 30. In an alternative, the liquid outlet 42 is oriented in an inclined fashion (e.g., from 10 to 45 degrees) relative to the extension direction of the separation wall.

The liquid inlet 41 may be formed as a single opening as illustrated in the illustrated example or be formed of two or more openings. Similarly, the liquid outlet 42 may be formed as a single opening as illustrated in the illustrated example or be formed of two or more openings.

The liquid injector 40 can be designed according to the beverage and/or nutritional ingredients, which are to be filled into the second compartment 22 of the capsule 10. For example, the liquid injector 40 can have a liquid outlet 42, which injects the liquid into the second compartment 22 as one liquid jet having high velocity. The liquid outlet 42 could also be designed to provide a plurality of liquid jets, or to provide a liquid spray (not jet-like) to the second compartment 22. For each desired form of liquid injection by the liquid injector 40, the liquid outlet 42 can be designed appropriately. For example, multiple comparably larger openings of the liquid outlet 42 promote a spraying effect. Comparably smaller and fewer openings promote high velocity liquid jets.

In a particular, non-limiting embodiment, the liquid injector 40 can further have an air inlet 44 for providing air into the second compartment 22. The air (in a particular, non-limiting embodiment) by-passes the filter 70. In other words, air injected in the capsule does not pass through the filter or first compartment but directly in the second compartment from the air inlet. In a particular, non-limiting embodiment, the liquid outlet 42 is an outlet for both air and liquid. Injected air can for example be used to promote liquid jets, or to ensure a complete draining of the liquid from the capsule 10 after beverage production.

Figure 3:
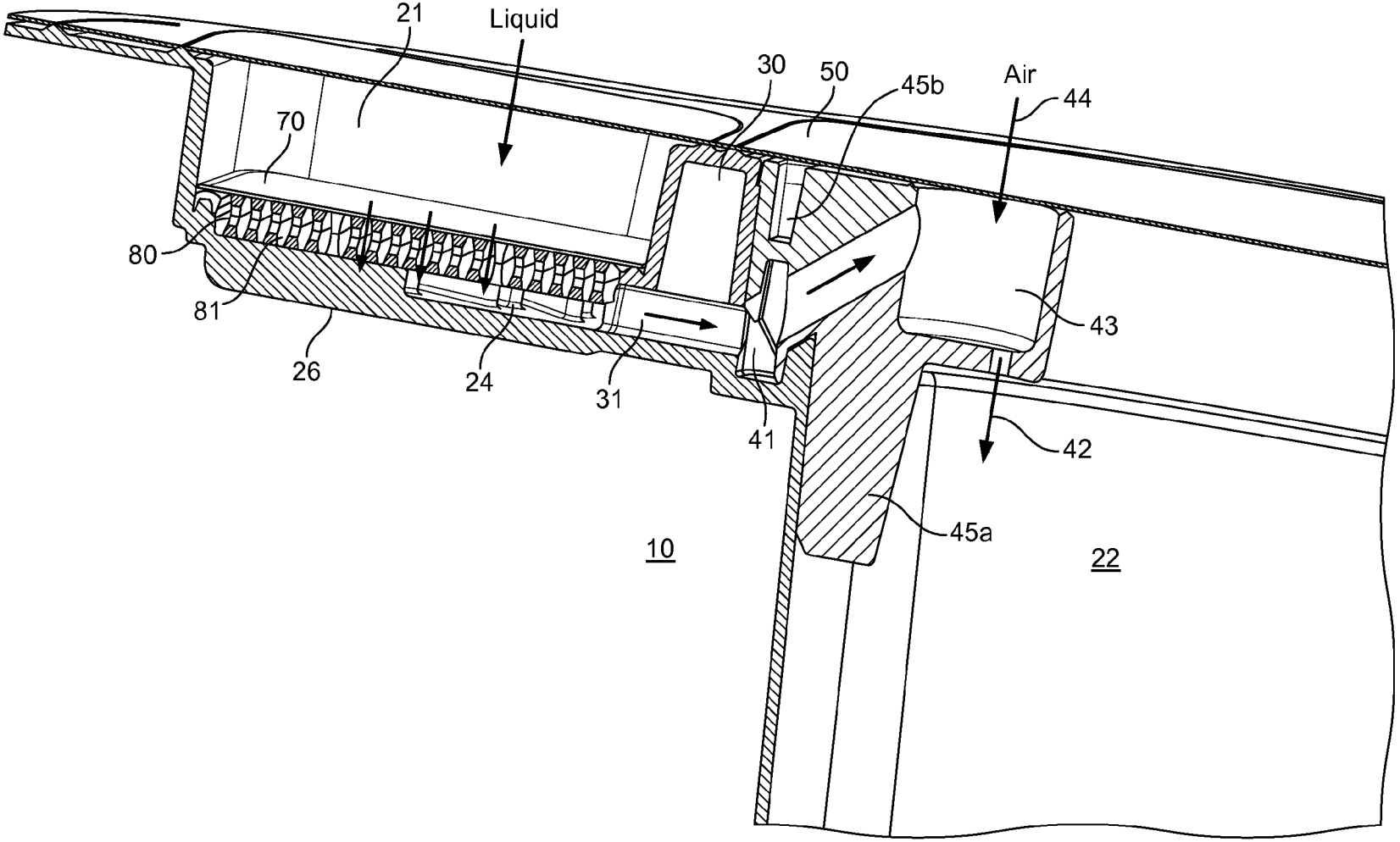
FIG. 3 shows an upper part of a capsule of the presently disclosed and/or claimed inventive concept(s).

FIG. 3 shows in more detail the upper part of the capsule 10 with the first compartment 21 and the liquid injector 40. In the first compartment 21 the support grid 80 is supported on distancing means 24 for providing a distance to the bottom wall 26. The distancing means 24 can be braces, which are provided on a surface of the support grid 80, or can be ridges, which are provided on the bottom wall 26 of the first compartment 21, so as to maintain a distance between support grid 80 and the bottom wall 26; such distance being sufficient (e.g., between 0.5-3 mm) for the liquid to circulate without excessive hindering or blockage. On the support grid 80 the filter 70 is supported. The filter 70 can be a nano- or microporous membrane. The filter 70 is further (in a particular, non-limiting embodiment) welded along its circumference to a step that can be provided in the first compartment 21, wherein the step is formed (in a particular, non-limiting embodiment) integrally with the body 20. The support grid 80 (in a particular, non-limiting embodiment) has a plurality of openings 81, through which liquid injected into the first compartment 21 by a beverage preparation machine and filtered by the filter 70 can pass.

Optionally, a bracing member (not shown) may be inserted in the first compartment 21 between the filter 70 and the membrane 50 to mechanically support the membrane and prevent it from collapsing and/or breaking accidentally. The bracing member may comprise transversal walls for supporting the membrane properly and transversal and/or axial openings for enabling injected liquid to be distributed across the entire surface area of the filter. The bracing member may further comprise a central tubular inlet wall for providing a support for the external liquid injection means. The bracing member can, for instance, be clipped to the sidewall of the compartment.

In FIG. 3, the flow path of liquid inside the capsule 10 is further indicated, when the capsule 10 is used in a beverage preparation machine. The liquid is provided to the capsule 10 by liquid injection means of the beverage preparation machine through the part of the upper membrane 50 that covers at least the first compartment 21. For example, the liquid injection means is a water injection needle or other equivalent means. The injected liquid, which is (in a particular, non-limiting embodiment) water or milk, is then filtered by the filter 70, and is further passed through the plurality of through-holes 81 of the support grid 80 supporting the filter 70. After passing these through-holes 81, the liquid flows along the flow path that is created by the distance of the supporting grid 80 to the bottom wall 26, enters the aperture 31 provided in the separation wall 30, and then enters the liquid inlet 40 of the liquid injector 40. The liquid flows further through the liquid injector 40, and is finally guided, (in a particular, non-limiting embodiment) vertically in respect to the upper membrane 50, through (in a, non-limiting embodiment) a vertically arranged liquid outlet 42 into the second compartment 22.

Within the liquid injector 40, the liquid can be guided or formed as desired. For example, the liquid can be formed into one or more liquid jets or liquid spray. The liquid injector 40 (in a particular, non-limiting embodiment) comprises an air channel 43, in which the liquid provided through the liquid inlet 41 is mixed with air, which is provided via an air inlet 44 separate from the liquid inlet 41. Air can be provided by an air injection means of the beverage producing device. An injection means for air through the membrane in the air channel 43 can be formed as a hollow needle or conduit. The injected air then flows together with the liquid through the liquid outlet 42 into the second compartment 22, where it interacts with the beverage and/or nutritional ingredients, causes a proper dissolution and produces a beverage and/or nutritional product, which exits the outlet 27 of the capsule 10.

Figure 6B:
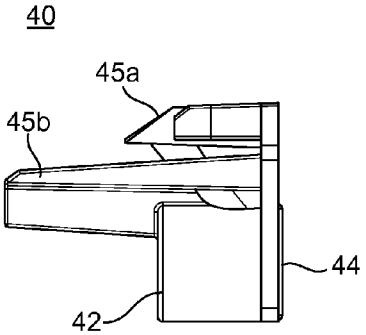
FIGS. 6*a* to 6*d* show perspective views of a liquid injector of a capsule of the presently disclosed and/or claimed inventive concept(s).
Figure 6D:
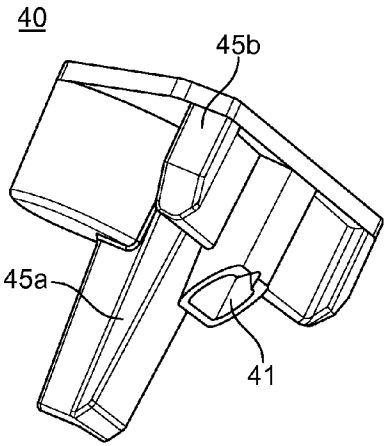
Figure 6A:
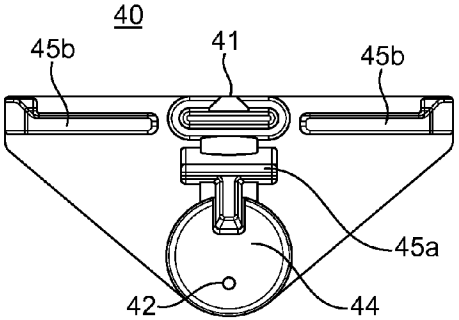
Figure 6C:
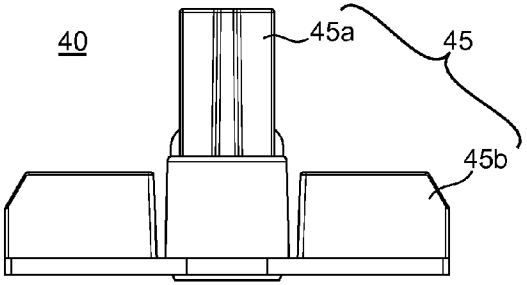

FIGS. 3 and 6*a* also show how the liquid injector 40 is provided with several insertion means 45 in order to position the liquid injector 40 stably in the capsule 10, and in a well defined position in respect to the first compartment 21 and the second compartment 22. More particularly, a front longer insertion member 45*a* engages against the separation wall 30 and rear lateral insertion members 45*b* are inserted into lateral slots of the separation wall 30. The insertion means 45, 45*a*, 45*b* are thus designed to provide a tight-fit mechanical arrangement between the liquid injector and the separation wall.

Figure 4:
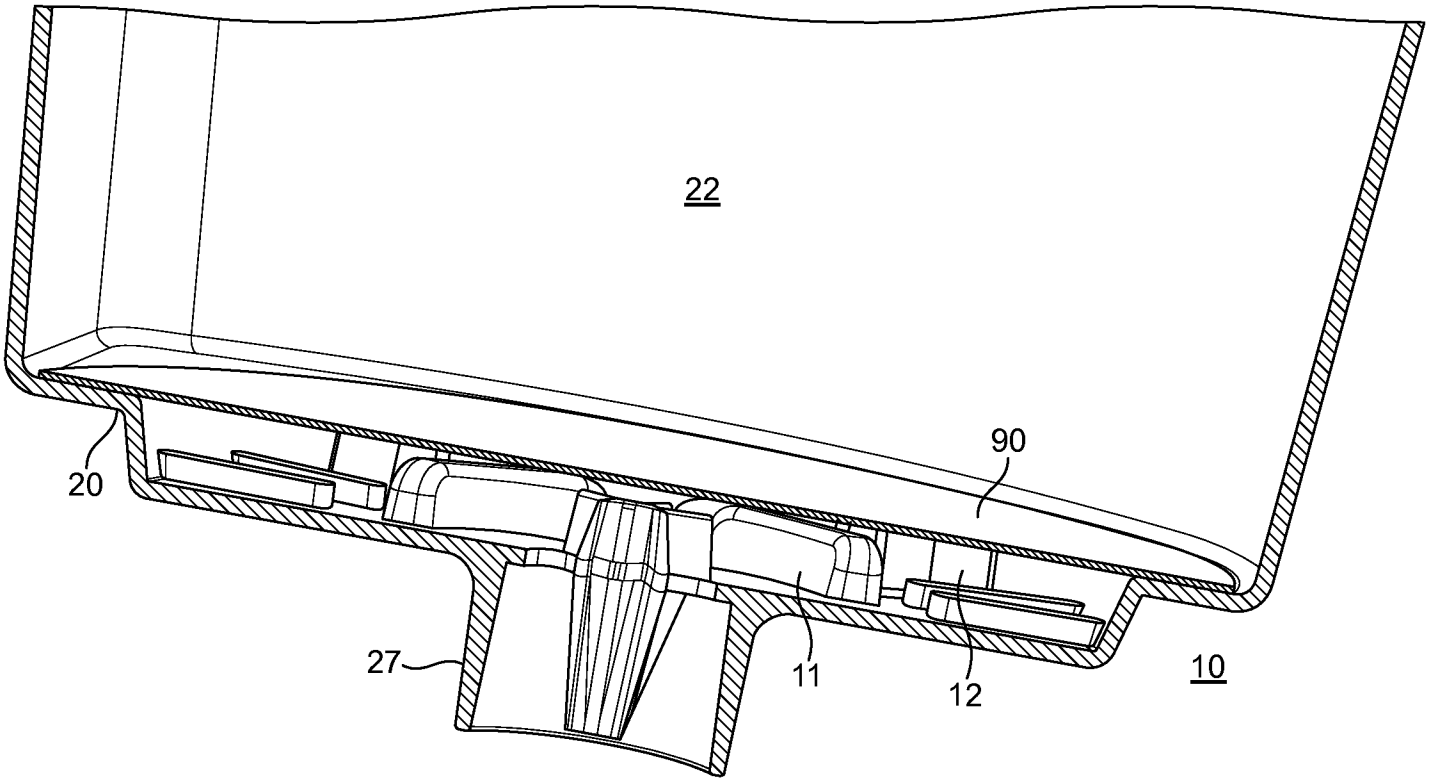
FIG. 4 shows a lower part of a capsule of the presently disclosed and/or claimed inventive concept(s).

FIG. 4 shows a bottom part of the capsule 10, wherein the bottom wall of the capsule 10 comprises an outlet structure 27. The capsule 10 is further provided with a lower membrane 90, which seals the beverage and/or nutritional ingredients inside the second compartment 22 to the outside before use, and thus prevents contamination. When liquid enters the second compartment 22, liquid pressure starts building up inside the second compartment 22, which finally presses the lower membrane 90 against a member 12 for tearing the lower membrane 90. When the membrane 90 is torn, the liquid can flow into the outlet structure 27 of the capsule 10. The lower part of the capsule 10 can be further provided with means 11 for redirecting, guiding and/or eventually emulsifying the liquid, which passes the torn lower membrane 90.

Figure 5A:
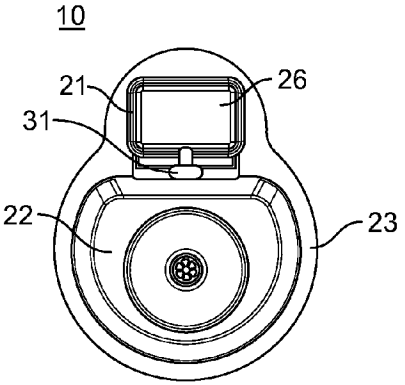
FIGS. 5*a* to 5*d* show perspective views of a capsule of the presently disclosed and/or claimed inventive concept(s).
Figure 5B:
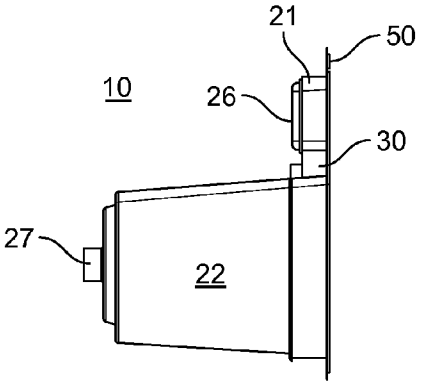
Figure 5C:
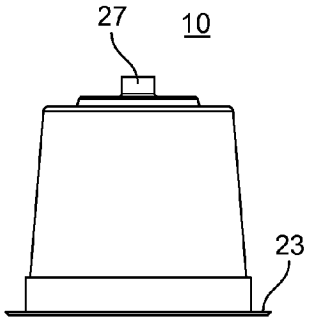
Figure 5D:
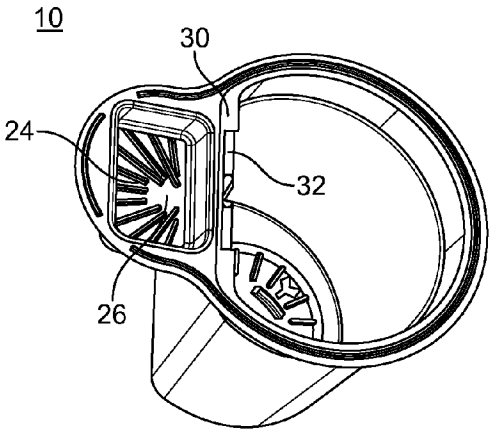

FIGS. 5*a*-5*d* show the capsule 10 in perspective views, respectively. FIG. 5*a* shows the capsule 10 from a top view, i.e. a view perpendicular to the surface of the upper membrane 50. When viewed from this perspective the first compartment 21 is arranged side-by-side with the second compartment 22. The first compartment 21 is of smaller cross-section than the second compartment 22. However, it could be envisaged that the first compartment is of about the same size as the second compartment, in particular, if it also contains a beverage or food ingredient. The aperture 31 for passing liquid from the first compartment 21 to the second compartment 22 is (in a particular, non-limiting embodiment) arranged orthogonally to the liquid/air injection direction into the capsule 10, which is (in a particular, non-limiting embodiment) perpendicular to the plane of the upper membrane 50. FIG. 5*b* shows that a volume of the second compartment 22 is much larger than a volume of the first compartment 21, and in a particular, non-limiting embodiment, by a ratio in the range of 2:1 to 20:1, such as but not limited to, 5:1 to 10:1. FIG. 5*d* shows ridges, which are provided to the bottom wall 26 of the first compartment 21. The ridges serve as the means 24 for distancing the support grid 80 from the bottom wall 26 of the first compartment 21.

FIGS. 6*a*-6*d* show the liquid injector 40. FIG. 6*a* shows the liquid injector 40 viewed from below (i.e. viewed perpendicular to the surface of the upper membrane 50). In FIG. 6*a* the fluid outlet 42 is a single opening of a diameter that is much smaller than the air inlet 44. The diameter of the fluid outlet 42 is in this case so small that a liquid and/or gas jet of high velocity is formed and is injected into the second compartment 22. The opening thus acts as a venturi. The diameter of the liquid outlet 42 is (in a particular, non-limiting embodiment) in the range of 0.1 to 1 mm, such as but not limited to, in the range of 0.2 to 0.7 mm. The liquid outlet 42 can also be a plurality of openings for providing multiple liquid jets or a liquid spray into the second compartment 22. For liquid spraying the plurality of openings of the liquid outlet 42 are (in a particular, non-limiting embodiment) in a range of 0.2 to 3 mm, such as but not limited to, in the range of 0.5 to 2 mm.

In FIG. 6*b*, the insertion means 45 are shown, wherein in the illustrated specific configuration first insertion means 45*a* are configured to be inserted into the receiving means 32 of the separation wall 30, and second insertion means 45*b* are configured to be inserted into the second compartment 22 so as to abut against the separation wall 30 for providing additional stability. FIG. 6*d* shows the liquid inlet 41, which is configured such that when the liquid injector 40 is inserted into the separation wall 30, the liquid inlet 41 is positioned to receive the liquid from the aperture 31. In a particular, non-limiting embodiment, the liquid inlet 41 is slanted against the direction of the aperture 31 so that the liquid is pushed upwards in the liquid injector 40, i.e. in direction of the opening mouth of the second compartment 22. As shown in FIG. 3, when air and liquid are injected at the same time, the liquid can then be pushed into an air channel 43 of the liquid injector 40, which acts as a mixing chamber for air, which is introduced via the air inlet 44, and the liquid.

Figure 7B:
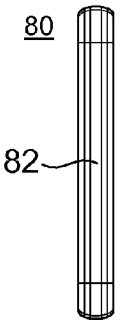
FIGS. 7*a* to 7*d* show perspective views of the support grid of a capsule of the presently disclosed and/or claimed inventive concept(s).
Figure 7D:
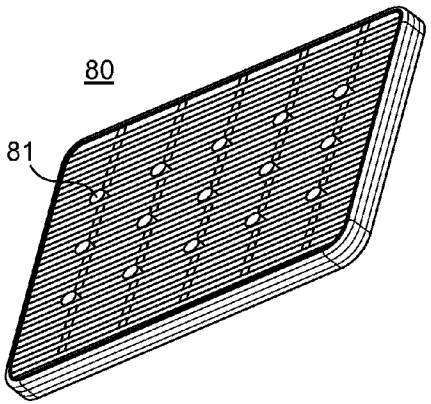
Figure 7A:
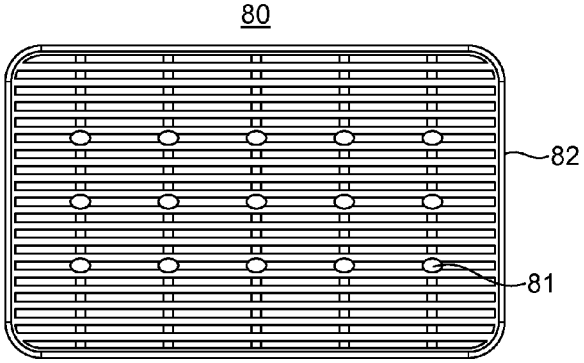
Figure 7C:
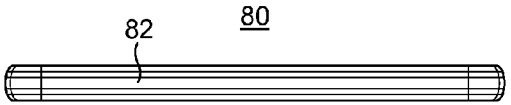
Figure 8A:
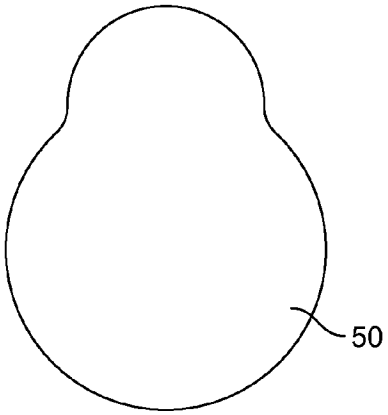
FIGS. 8*a* to 8*d* show perspective views of an upper membrane of a capsule of the presently disclosed and/or claimed inventive concept(s).
Figure 8B:
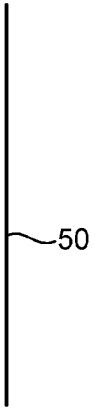
Figure 8C:
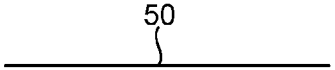
Figure 8D:
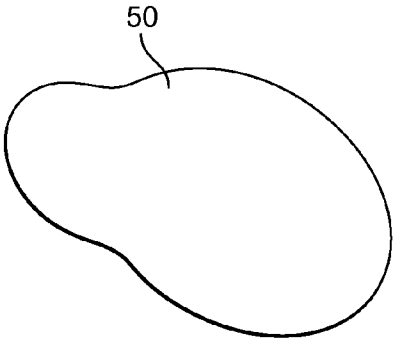

FIGS. 7*a*-7*d* show perspective views of the support grid 80. FIG. 7*a* shows that the support grid 80 is provided with a plurality of through-holes 81 for the liquid filtered by the filter 70. The through-holes 81 can be arranged periodically in perpendicular directions on the support grid 80 as shown in FIG. 7*a*. However, the through holes 81 can also be arranged in other ways. The through holes have (in a particular, non-limiting embodiment) a diameter of 0.2 to 3 mm, such as but not limited to, 0.5 to 2.5 mm, or 1 to 2 mm.

The support grid 80 is (in a particular, non-limiting embodiment) clipped into the first compartment 21. To this end the support grid 80 (in a particular, non-limiting embodiment) has a peripheral ridge 82, which is suited for clipping the support grid 80 into the first compartment 21, or is shaped to interact with fastening means in the first compartment 21 so as to provide a stable positioning of the support grid 80. The support grid 80 shown in FIGS. 7*a* and 7*b* is (in a particular, non-limiting embodiment) rectangular and flat and matches the size of the filter 70. In a particular, non-limiting embodiment, the support grid 80 is supported on ridges on the bottom wall 26 of the first compartment 21 as described before. Alternatively, the support grid 80 can be provided on one of its surfaces which braces or other means 24 for maintaining a distance to the bottom wall 26.

FIGS. 8*a*-8*d* show perspective views of the upper membrane 50. In particular, the shape of the upper membrane 50 is the same as the shape of the cross-section of the capsule 10 when viewed from above. The shape (in a particular, non-limiting embodiment) resembles two circles of different diameter, which overlap each other. The smaller circle defines the mouth size of the first compartment 21, the larger circle defines the mouth size of the second compartment 22. The upper membrane 50 is (in a particular, non-limiting embodiment) made of a metal like aluminum, or a laminate of plastic and metal, or a laminate of plastics, and has a thickness (in a particular, non-limiting embodiment) in a range of 0.05 to 1 mm.

In summary, the presently disclosed and/or claimed inventive concept(s) provides a capsule 10, which has two compartments 21 and 22 that are separated by a separation wall 30. The first compartment 21 is for injecting a liquid by a beverage preparation machine into the capsule 10. The second compartment 22 is for containing a beverage or nutritional ingredients. Thus the ingredients are prevented from contamination, since no direct contact to outside means occurs.

Into the separation wall 30 or against the separation wall 30 is inserted a separate liquid injector 40 for transferring liquid that is injected into the first compartment 21 to the second compartment 22. The liquid injector 40 can form a directed jet of liquid or a spray of liquid for injection into the second compartment 22. Different liquid injectors 40 can be used for capsules 10 to be filled with different beverage and/or nutritional ingredients. Thus, the capsule 10 of the presently disclosed and/or claimed inventive concept(s) enables a more versatile choice for an injection solution, and a proper dissolution of the ingredients can be ensured.

A filter 70 is (in a particular, non-limiting embodiment) present in the first compartment 21 to remove contaminants from the injected liquid before the transfer by the liquid injector 40. The filter may pertain to different filtering technology upon specific needs such as a micro-porous membrane, active carbon or ion-exchange resins, as possible examples. Thus, the risk of a contamination of the beverage and/or nutritional ingredients is further reduced. The solution of the capsule 10 according to the presently disclosed and/or claimed inventive concept(s) provides also the possibility for added functionalities like filtering or foaming, either on the outlet side of the capsule 10 or by means of the liquid injector 40.

Alternatively, the first compartment is free of filter and may even contain a food or beverage ingredient which becomes transferred with the injected liquid, from the first to the second compartment, which contains a second ingredient in the second compartment.

As an example, the first compartment may comprise a probiotic or probiotics, a taste enhancer, a sweetener, a flavor, a colorant, minerals, vitamins, other food additives, a creamer and combinations thereof.

For assembling the capsule 10, the body 20 is manufactured first, and in a particular, non-limiting embodiment, integrally. Then (in a particular, non-limiting embodiment) the filter 70 and the support grid 80 are clipped into the first compartment 21, the liquid injector 40 is inserted into the separation wall 30, and the capsule 10 is sealed by the upper membrane 50 and the lower membrane 90. Manufacturing and assembly of the capsule 10 is thus very simple, and of low cost. Overall, the capsule 10 of the presently disclosed and/or claimed inventive concept(s) provides significant advantages in view of the prior art.

The invention claimed is:

1. A capsule for preparing a beverage and/or nutritional product, comprising:

a body for forming integrally a first compartment for liquid injection and a second compartment for containing beverage and/or nutritional ingredients, a separation wall for separating the first compartment and the second compartment, the separation wall comprising an aperture for the liquid transfer from the first compartment to the second compartment, a separate liquid injector comprising a liquid inlet and a liquid outlet, wherein the liquid injector is inserted in and/or against the separation wall, and is arranged for transferring liquid from the first compartment to the second compartment, and an upper membrane for closing the first compartment and the second compartment, the upper membrane being sealed on the separation wall and on edges of the first and second compartments.

2. The capsule according to claim 1, wherein the liquid injector comprises an air injection channel with an air inlet separate from the liquid inlet.

3. The capsule according to claim 2, wherein the liquid outlet of the liquid injector also functions as air outlet.

4. The capsule according to claim 3, wherein the first compartment and the second compartment are arranged adjacent to each other in a direction that is orthogonal to the liquid and/or air inlet of the liquid injector.

5. The capsule according to claim 1, wherein the liquid injector an has insertion means for fitting the liquid injector into a complementary receiving means of the separation wall.

6. The capsule according to claim 5, wherein the insertion means and receiving means are arranged to permit an insertion of the liquid injector in or along the direction of extension of the separation wall.

7. The capsule according to claim 5, wherein the insertion means are shaped as teeth and/or studs.

8. The capsule according to claim 5, wherein the receiving means are recesses and/or slots.

9. The capsule according to claim 1, wherein the first compartment and the second compartment are side-by side when viewed perpendicular to the upper membrane.

10. The capsule according to claim 1, wherein a filter is welded into the first compartment.

11. The capsule according to claim 10, wherein the filter is selected from the group consisting of a nano- or micro-porous membrane, a filtering porous block, ion-exchange resin, an active carbon filter, an adsorbing or desorbing medium, a metallic mesh screen, a filtering bed of inert particles, and combinations thereof.

12. The capsule according to claim 11 wherein the filtering porous block is consisting of a sintered ceramic material or a sintered metallic material.

13. The capsule according to claim 10, further comprising a support grid for supporting the filter in the first compartment.

14. The capsule according to claim 13, wherein the support grid is clipped in the first compartment.

15. The capsule according to claim 13, wherein:

the support grid is supported on a bottom wall of the first compartment, the support grid comprises a plurality of through holes, and the support grid and/or the first compartment comprises means for maintaining a flow path between the bottom wall of the first compartment and the support grid.

16. A method for manufacturing a capsule for preparing the beverage or nutritional product according to claim 1, comprising the steps of:

forming integrally a first compartment for liquid injection and a second compartment for containing beverage and/or nutritional ingredients of a body, the first and second compartments separated by a separation wall, providing a liquid injector comprising a liquid inlet and a liquid outlet, and inserting the liquid injector in and/or against the separation wall so that the liquid injector is arranged for transferring liquid from the first compartment to the second compartment.

* * * * *